US008336566B2

(12) United States Patent
Jarrett

(10) Patent No.: US 8,336,566 B2
(45) Date of Patent: Dec. 25, 2012

(54) DETACHABLE GUTTER SYSTEM FOR USE WITH AN UMBRELLA

(76) Inventor: Glen Oliver Jarrett, Hartford, CT (US)

( * ) Notice: Subject to any disclaimer, the term of this patent is extended or adjusted under 35 U.S.C. 154(b) by 218 days.

(21) Appl. No.: 10/756,520

(22) Filed: Jan. 14, 2004

(65) Prior Publication Data

US 2004/0163692 A1 Aug. 26, 2004

Related U.S. Application Data

(63) Continuation-in-part of application No. 10/028,066, filed on Mar. 22, 2002, now abandoned.

(51) Int. Cl.
*A45B 25/18* (2006.01)

(52) U.S. Cl. ..... 135/33.2

(58) Field of Classification Search ..... 135/48, 135/27, 31, 33.2, 33.4, 33.41, 33.5, 44
See application file for complete search history.

(56) References Cited

U.S. PATENT DOCUMENTS

| | | | | | |
|---|---|---|---|---|---|
| 74,944 | A | * | 2/1868 | Schreiner | 135/33.2 |
| 664,157 | A | * | 12/1900 | Killmer | 135/33.2 |
| 1,603,084 | A | * | 10/1926 | Katz | 135/33.5 |
| 1,706,341 | A | * | 3/1929 | Zussman | 135/33.71 |
| 2,625,353 | A | * | 1/1953 | Charles | 248/48.2 |
| 2,777,405 | A | * | 1/1957 | Ager | 52/16 |
| 3,042,056 | A | * | 7/1962 | Todorovic | 135/33.2 |
| 4,834,126 | A | * | 5/1989 | Sweet, Jr. | 135/15.1 |
| 5,406,756 | A | * | 4/1995 | Bemis et al. | 52/16 |
| 5,452,743 | A | * | 9/1995 | Rortvedt | 137/615 |
| 5,823,212 | A | * | 10/1998 | Allen | 135/16 |
| 5,862,632 | A | * | 1/1999 | Zima | 52/16 |
| 6,223,777 | B1 | * | 5/2001 | Smith et al. | 138/109 |
| 6,240,680 | B1 | * | 6/2001 | Estes | 52/16 |

FOREIGN PATENT DOCUMENTS

| | | | | |
|---|---|---|---|---|
| DE | 3209 | * | 3/1809 | 135/33.2 |
| DE | 3328124 | * | 2/1985 | |
| FR | 2847608 | * | 5/2004 | |
| GB | 5261 | * | 0/1889 | 135/33.2 |
| GB | 18877 | * | 0/1891 | 135/33.2 |
| JP | 7148013 | * | 6/1995 | |
| JP | 07148013 A | * | 6/1995 | |
| JP | 2001245718 | * | 9/2001 | |
| JP | 2002177029 | * | 6/2002 | |
| JP | 20023062222 | * | 10/2002 | |

* cited by examiner

*Primary Examiner* — Noah Chandler Hawk
(74) *Attorney, Agent, or Firm* — McCormick, Paulding & Huber LLP

(57) ABSTRACT

The "Umbrella Water Control" is a gutter with tubes, affixed to the circumference of the umbrella. It is snapped onto the circumference of the umbrella, which is supported by a retractable frame. The gutter channels the water flowing off the umbrella's surface through the tubes. The gutter is made of plastic and nylon (or material used to make the umbrella covering). All tubes are made of plastic and act like a straw to funnel the water. They are joined into one main tube that extends along the stick of the umbrella. At the end of the main tube is an added extension that is made to open like an antenna where the water continues. This allows the user to direct where the water flow is deposited. This prevents the excess dripping of water on by-standers as the umbrella user walk, sits or stands in an arena, stadium or crowded area.

18 Claims, 5 Drawing Sheets

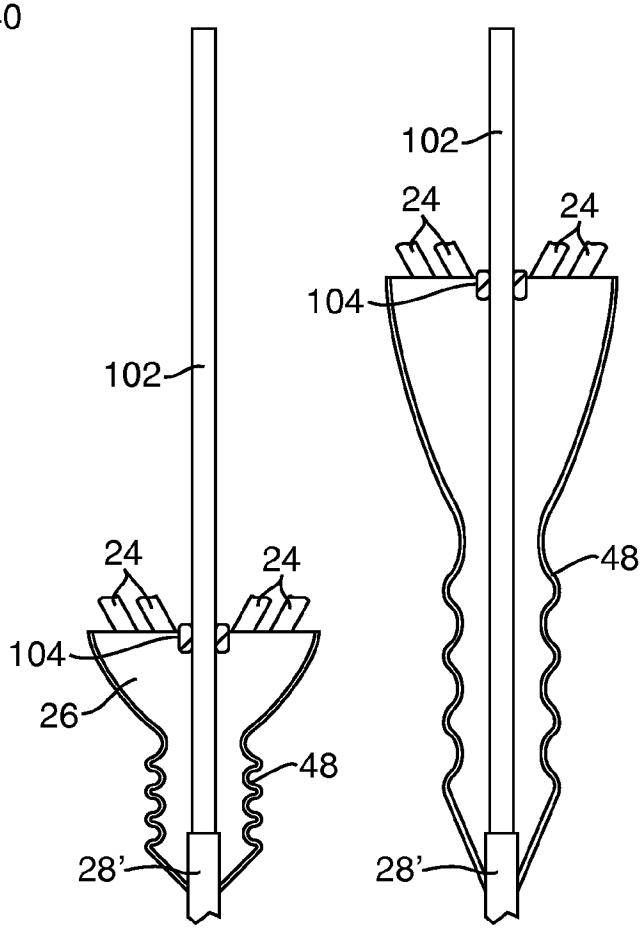
FIG. 9A
FIG. 9
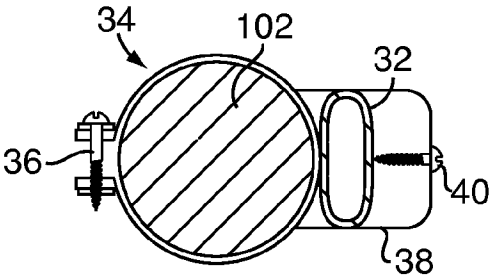
FIG. 7
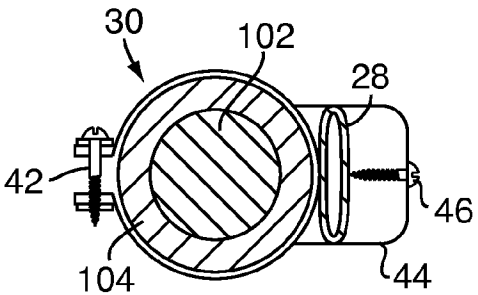
FIG. 8
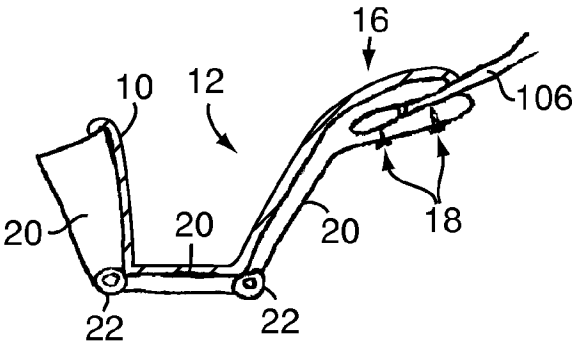
FIG. 6
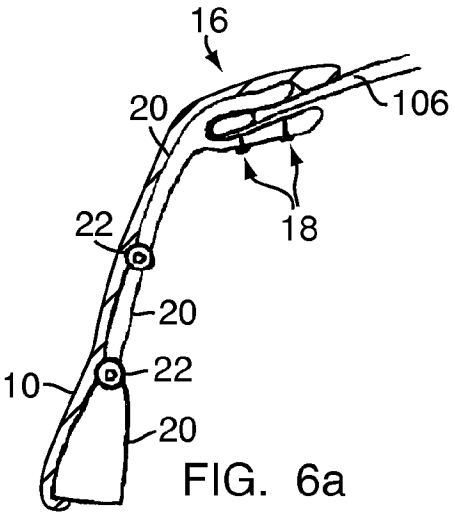
FIG. 6a

DETACHABLE GUTTER SYSTEM FOR USE WITH AN UMBRELLA

CROSS-REFERENCE TO RELATED APPLICATIONS

This is a continuation-in-part from application Ser. No. 10/028,066, filed on Mar. 22, 2002, now abandoned which is incorporated herein by reference.

FIELD OF THE INVENTION

The present invention relates generally to a detachable gutter system for use with an umbrella for controlling and draining water collected on the umbrella when it is in an open condition.

BACKGROUND OF THE INVENTION

The present invention relates to a detachable gutter system designed to control and drain water collected on an opened umbrella when it is raining. A conventional umbrella design 100, generally illustrated in FIG. 1, comprises a central pole 102, an adjustor 104 mounted for movement on the central pole 102, a plurality of spokes 106 extending from the central pole 102 and movable between an open position and a closed position in connection with movement of the adjustor 104, and a flexible fabric cover 108 attached to the spokes 106. The spokes 106 generally define a frame on which the fabric cover 108 lays. When such a frame is opened, the fabric cover 108 generally resembles a dome, as shown in FIG. 1. When the frame is closed, the fabric cover 108 is relaxed and the umbrella 100 resembles a spear (not shown), as is generally known by one of ordinary skill in the art. Accordingly, the open and closed position of the spokes 106 generally corresponds with the open and closed conditions of the umbrella 100.

Existing umbrella designs have dealt with collecting rain water from an umbrella. For example, U.S. Pat. No. 5,178,175, entitled "Removable rain water collecting device for umbrellas;" U.S. Pat. No. 5,161,560, entitled "Umbrella holder with raindrops collecting means;" and U.S. Pat. No. 5,385,162, entitled "Umbrella having automatically closed water collector," each shows an apparatus designed to collect water from an umbrella after the umbrella is closed. Each invention is designed to avoid messy cleanup and dripping after the umbrella is closed.

Other umbrella designs have utilized troughs for collecting rain water around the perimeter of an opened umbrella, such as U.S. Pat. No. 3,042,056, entitled "Eave Trough Construction;" U.S. Pat. No. 1,706,341, entitled "Umbrella Attachment;" and U.S. Pat. No. 664,157, entitled "Umbrella Cover." However, in such designs, the collected rain water is removed from the troughs by tilting the umbrella, which can still get the user or nearby individuals wet from splashing water, all while exposing the user to the rain when the umbrella is tilted. Accordingly, what is needed is an umbrella that can collect rain water while the umbrella is being used and direct it away from the umbrella's user and nearby individuals without getting anyone wet.

BRIEF SUMMARY OF INVENTION

The detachable gutter system in accordance with the present invention is designed to collect and channel rain water off an opened umbrella and away from the user and other people standing or sitting near the user while the umbrella is in use. Unlike the prior art inventions identified above, the present invention does not require the user to tilt the umbrella in order to drain any collected water. In accordance with preferred embodiments of the present invention, water may be drained from all sides of the umbrella using a gutter extending around the circumference of the umbrella and a drainage path extending from the gutter and defined by a series of straw-like drainage tubes that connect the gutter to a main tube extending down the umbrella's central pole and handle. The water can be directed out from the main tube away from the umbrella towards the ground, for example, using an extension member that permits the user to direct the drained water away from the umbrella. In this regard, the present invention also shelters surrounding people from rain water that may drip off the umbrella while in use.

Unlike the prior art inventions identified above, the present invention is detachable from the umbrella. Thus, it can be attached to the umbrella in rainy conditions, but otherwise removed, where desired.

Objective 1: To avoid wetting others around the user of an umbrella with the flow of water dripping from the umbrella.

Objective 2: To provide a device that is inexpensive to manufacture.

Objective 3: To provide a device that is easy to put in place (affix) on an umbrella, as well as remove therefrom.

Objective 4: To have the choice of opening the detachable gutter system and use it as a gutter umbrella, or relaxing or closing the system and using the umbrella as a normal umbrella without a set-up gutter system.

Objective 5: To provide the user with the ability to control the flow of water off the umbrella surface and where it will be deposited.

Objective 6: To provide a device that can be adaptable to all types of umbrellas, such as a hand-held umbrella or a picnic table umbrella.

BRIEF DESCRIPTION OF THE DRAWINGS

FIG. 6 shows a side view of a frame connector mechanism of the detachable gutter system of FIG. 2 used for attaching the gutter portion of the detachable gutter system to the umbrella of FIG. 1 in accordance with an embodiment of the present invention, wherein the frame connector mechanism is illustrated in a set-up condition.

FIG. 6*a* shows a side view of the frame connector mechanism of FIG. 6 in a retracted, relaxed condition.

FIG. 7 shows a top planar view of an attachment clip for attaching a tube of the detachable gutter system of FIG. 2 to the umbrella of FIG. 1.

FIG. 8 shows a top planar view of another attachment clip for attaching a tube of the detachable gutter system of FIG. 2 to the umbrella of FIG. 1.

FIG. 9 shows a partial cross-sectional view of a connection mechanism in accordance with an embodiment of the present invention illustrating a connection point for the connector tubes of the detachable gutter system, and further illustrating a portion of the main tube as a bellows means permitting the umbrella to open and close with the detachable gutter system attached thereto, with the bellows means shown in a retracted condition.

FIG. 9*a* shows a partial cross-sectional view of the connection mechanism of FIG. 9 with the bellows means shown in an extended condition.

DETAIL DESCRIPTION OF THE INVENTION

Figure 2:
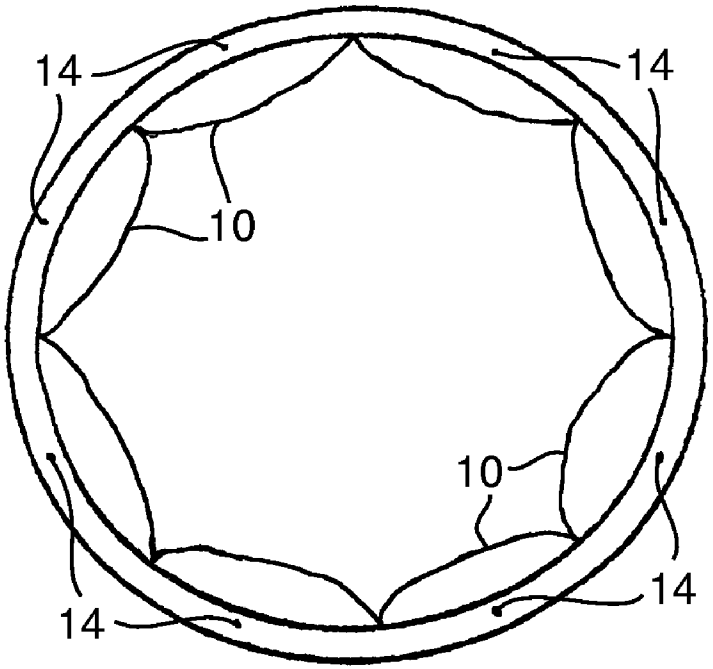
FIG. 2 shows a top planar view of a detachable gutter system in accordance with the present invention that may be affixed around the circumference of the umbrella of FIG. 1.
Figure 2A:
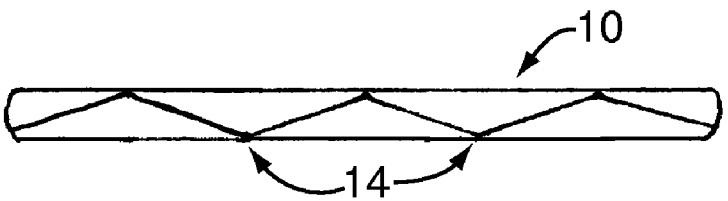
FIG. 2*a* shows a side cross-sectional view of a gutter portion of the detachable gutter system of FIG. 2, illustrating drainage points that are provided therein to drain water from the gutter portion.
Figure 4:
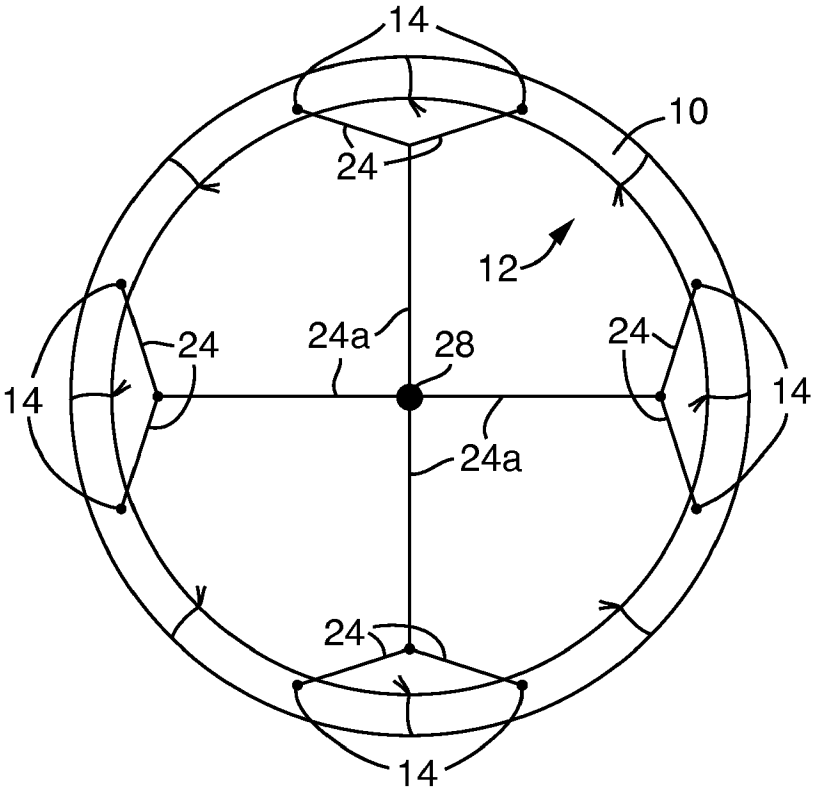
FIG. 4 shows a bottom planar portion of the detachable gutter system of FIG. 2 illustrating connector tubes that drain the rain water collected in the gutter portion through a main tube attached to the central pole of the umbrella.
Figure 3:
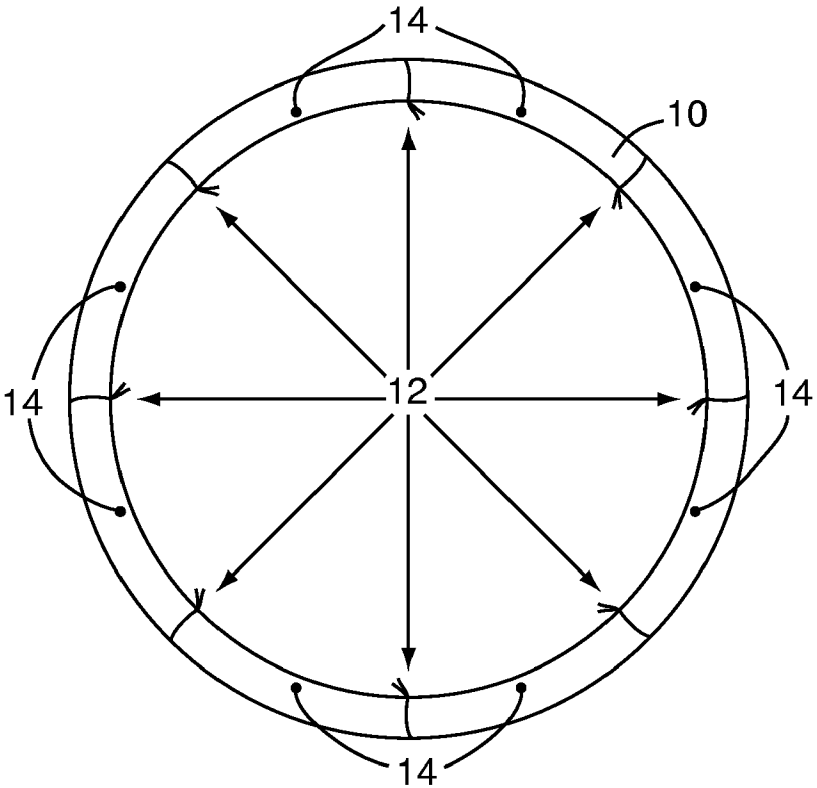
FIG. 3 shows a bottom planar view of the gutter portion of the detachable gutter system of FIG. 2, illustrating attachment means for attaching the gutter portion to the umbrella of FIG. 1, in accordance with a preferred embodiment of the present invention.
Figure 5A:
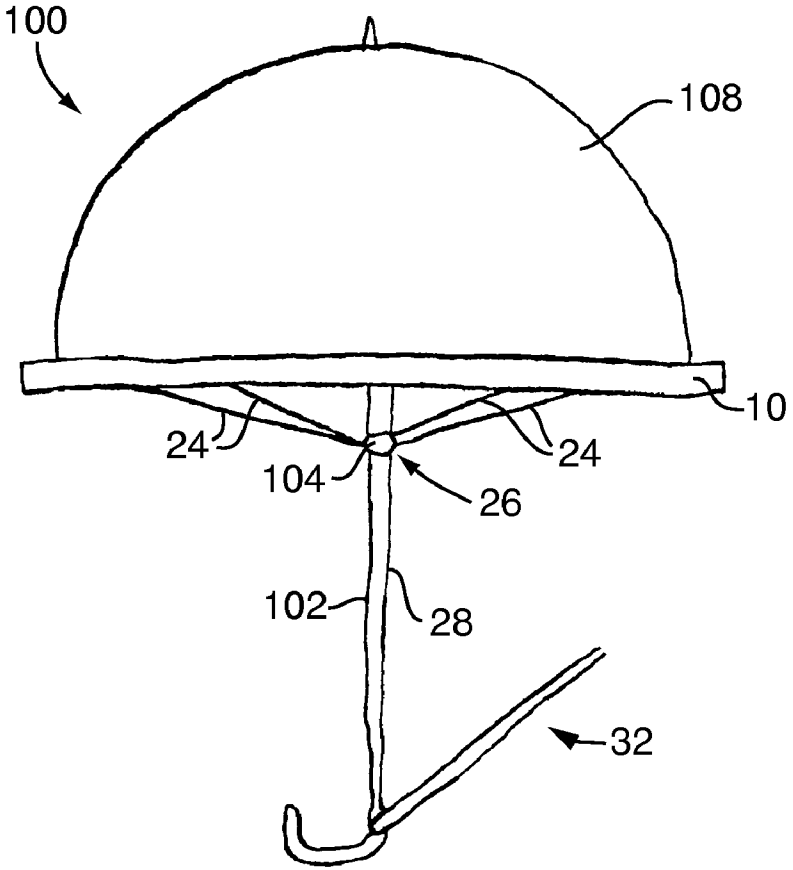
FIGS. 5 and 5*a* show side planar views of the detachable gutter system of FIG. 2 attached to the umbrella of FIG. 1.
Figure 5:
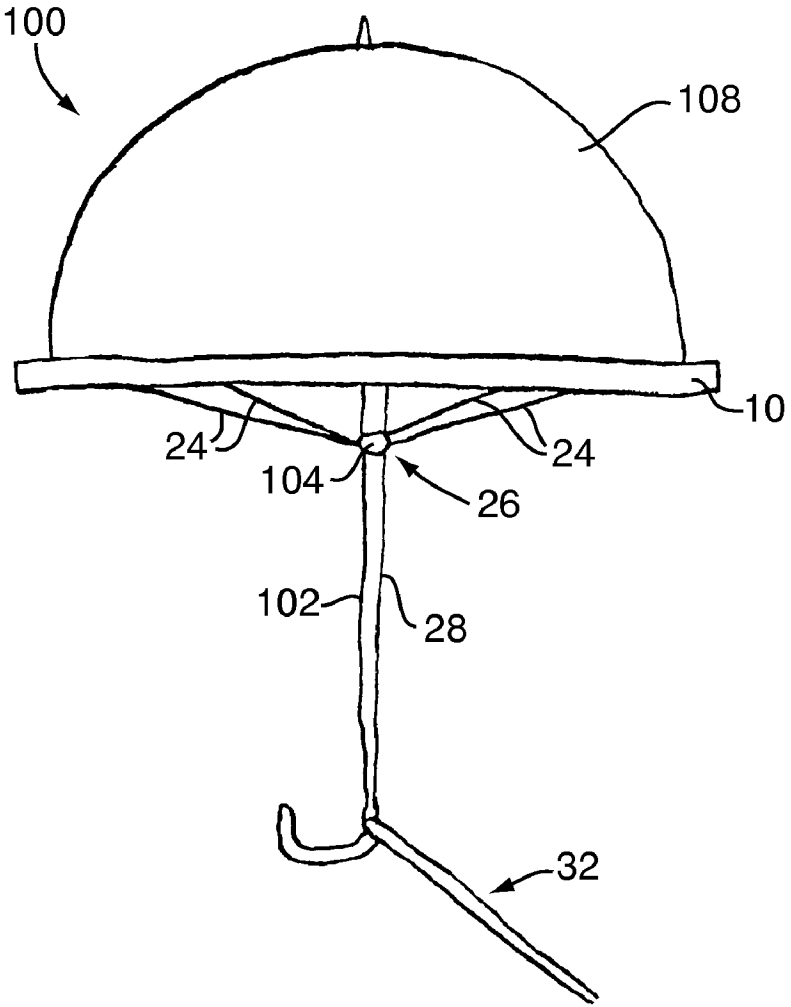

Referring to FIGS. 2-5, a detachable gutter system for use with a conventional umbrella 100 is illustrated. In accordance with the present invention, the detachable gutter system is designed to drain water collected on the umbrella 100 when the umbrella 100 is in an open condition—namely, when it is raining and a user is using the umbrella 100 as intended. As shown in FIGS. 2, 2*a* and 3, the detachable gutter system in accordance with a preferred embodiment comprises a gutter 10 affixed to the circumference of the umbrella 100, preferably by way of the umbrella's spokes 106 (illustrated in FIG. 1). For example, the gutter 10 is snapped onto the spokes 106 using frame connectors 12, illustrated in FIG. 3, and positioned around the circumference of the umbrella 100. As so positioned, the gutter 10 is used to channel the water flowing off the surface of the umbrella's fabric cover 108 through a drainage path, illustrated generally in FIGS. 4 and 5. In accordance with a preferred embodiment of the present invention, the drainage path starts at drainage points 14 formed in the gutter 10, and comprises a plurality of tubes extending from the drainage points, down the central pole 102 of the umbrella 100, and directed away from the umbrella 100, such as illustrated in FIGS. 5 and 11. Accordingly, the detachable gutter system of the present invention prevents the excess dripping of water on by-standers as the umbrella user walks, sits or stands in an arena, stadium or crowded area.

The gutter 10 is preferably made of a plastic or nylon material (or any known material conventionally used to make the fabric covering 108 of the umbrella 100) with a light rubbery stretch that will permit the gutter 10 to stretch along the outside of the circumference of the umbrella 100 for easy attachment thereto, and collapse with the umbrella 100 when the umbrella 100 is closed. The inner edge of the gutter 10 is made to stick to or otherwise attach to the umbrella 100, for example, to the inside of the umbrella's fabric cover 108. This allows the gutter 10 to be evenly distributed around the circumference of the umbrella 100. The gutter 10 is secured to the umbrella 100 in such a way that the water collected in the gutter 10 is directed towards the drainage points 14, shown in FIG. 2. As shown in FIG. 2*a*, the drainage points 14 can be formed by angled details in the gutter 10 that direct the water to a drainage point 14 in each segment of the gutter 10, wherein the gutter segments are evenly distributed around the circumference of the umbrella 100. Such a design and arrangement of the drainage points 14 helps prevent excess water from settling in the gutter 10. The angled details may be defined, in part, by the frame connectors 12 dispersed about the gutter 10. As shown in FIGS. 3 and 4, the location of each drainage point 14 is between two adjacent frame connectors 12, which cause the gutter material at each frame connector 12 to be more taut than at the drainage point, thereby forming the angled detail within the gutter 10.

Figure 1:
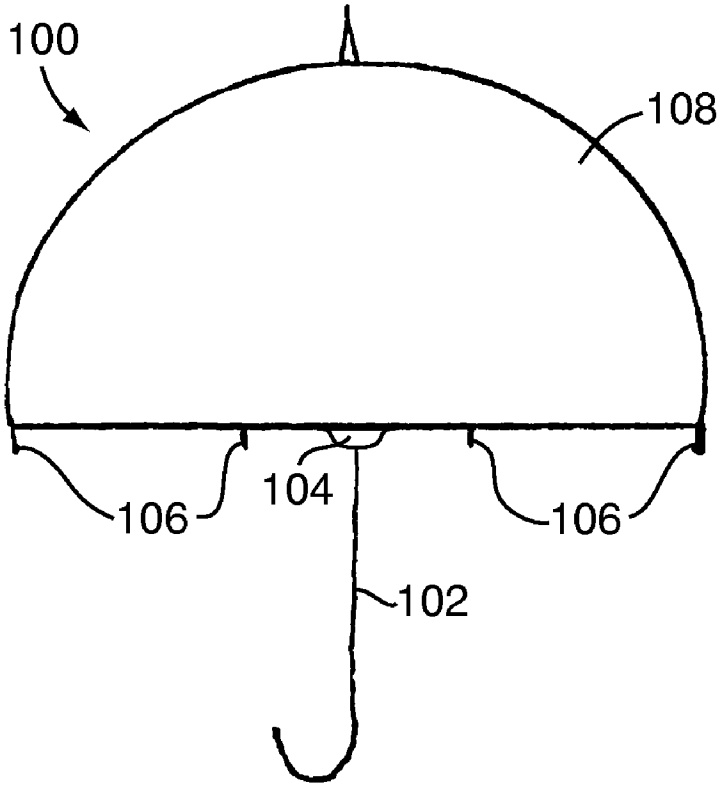
FIG. 1 Prior Art
FIG. 1 shows a planar side view of an umbrella representative of the prior art, that can be used with a detachable gutter system in accordance with the present invention, wherein the umbrella generally comprises a central pole, an adjustor mounted for movement on the central pole, and a frame comprising a plurality of spokes extending from the central pole and moveable between an open position and a closed position in connection with movement of the adjustor, and that supports a fabric covering of the umbrella.

Referring to FIG. 3, the gutter 10 is preferably attached to the umbrella 100 using the existing spokes 106 of the umbrella 100. More particularly, frame connectors 12 connect the gutter 10 to one or more of the spokes 106, provide support for the gutter 10, and help maintain the shape of the gutter 10 during use. Preferably, a frame connector 12 is provided for each spoke 106 on the umbrella 100 (usually eight for a conventional umbrella design, such as illustrated in FIG. 1) so that the gutter 10 is evenly sealed and balanced between all the spokes 106 of the umbrella 100. An example of a frame connector 12 used with the detachable gutter system of the present invention is shown in FIGS. 6 and 6*a*. As shown, the frame connector 12 comprises a retractable elbow connector made with a clip 16 at one end that is snapped on to the end of an umbrella spoke 106. Two screws 18 adjust the grasp of the clip 16 and hold the frame connector 12 to the umbrella 100. The elbow connector 12 is further comprised of a plurality of members 20 pivotally connected to each other by pivot joints 22 that permit the user to set up the elbow connector 12 in a U-shape to support and provide shape to the gutter 10 (FIG. 6) or retract the elbow connector 12 to a relaxed, straight shape (FIG. 6*a*). Thus, the retractable elbow connector design further gives the user the option of using the gutter 10 when the elbow connector 12 is in a set-up condition, such as opened to an 80° angle as shown in FIG. 6, or not, when the elbow connector 12 is in a relaxed condition, such as shown in FIG. 6*a*. When the elbow connector 12 is in its set-up condition, the elbow connector shape helps give the gutter 10 its shape, defining a channel for directing water towards the drainage points 14. Spreading the elbow connectors 12 around the circumference of the umbrella 100, such as shown in FIG. 3, also helps define an angular shape within the gutter 10, as illustrated in FIG. 2*a*, that helps direct water towards the drainage points 14 and prevent excess water from collecting within the gutter 10. When the retractable elbow connectors 12 are in the relaxed condition, the gutter 10 lays flat with the elbow connectors 12, due to the material used for the gutter 10, and acts not as a gutter for collecting water, but merely as an extension of the umbrella's fabric covering 108.

Referring to FIGS. 2 and 4, in a preferred embodiment of the present invention, the gutter 10 is provided with eight drainage points 14 evenly distributed around the circumference of the umbrella 100. Connected to the gutter 10 are several connector tubes 24 that drain the water from the gutter 10. The connector tubes 24, forming part of the drainage path of the detachable gutter system, are joined together at a central collection point 26 to drain the water into one main tube 28 that extends along the central pole 102 of the umbrella 100. The main tube 28 is fastened with a clip 30, depicted in greater detail in FIG. 8, that is affixed to the adjuster 104 of the umbrella 100 (i.e., the part of the umbrella 100 that controls the opening and closing of the umbrella 100). All tubes of the drainage path are preferably made of plastic and act like a straw to funnel the water from the drainage points 14 towards the ground, away from the umbrella's user or people walking, standing or sitting nearby. At the end of the main tube 28 is an extension member 32, as shown in FIG. 5, through which the water continues to flow, and which allows the user to direct the water away from the umbrella 100 where he or she chooses.

In an embodiment of the invention shown in FIG. 4, the drainage path can comprise eight connector tubes 24, each associated with and attached to a respective drainage point 14 in the gutter 10. Two or more connector tubes 24 may then converge into intermediate drainage tubes for draining water from the two or more drainage points 14 to the main tube 28 of the drainage path. For example, as shown in FIG. 4, the eight connector tubes 24 converge as adjacent pairs into four intermediate connector tubes 24*a*, that thereafter all converge together to funnel the water from the drainage points 14 to the centrally-located main drainage tube 28.

FIGS. 5 and 5*a* show one embodiment of the detachable gutter system of the present invention installed on a traditional umbrella 100. The gutter 10 is fastened to the spokes 106 of the umbrella 100 using retractable elbow connectors as the frame connectors 12, as described above. The connector tubes 24 funnel water from the drainage points 14 in the gutter 10 to the main tube 28 (possibly using the intermediate connector tubes 24*a* as shown in FIG. 4) at the adjustor 104 of the umbrella 100 where the main tube 28 is attached to the umbrella 100 using the clip 30. The main tube 28 funnels the water to the extension member 32, which is attached to the central pole 102 of the umbrella 100 using a clip 34, which is illustrated in more detail in FIG. 7. As shown, the extension member 32 projects away from the central pole 102 of the umbrella 100 at an angle, allowing the user to direct the drained rain water away from the umbrella 100 and towards the ground wherever and in whatever direction he or she wishes to release the water. The extension member 32 may be made to pivotally flip up and down, as desired. When in the "down" position, as shown in FIG. 5, the drainage path allows the water to flow from the gutter 10, through the drainage points 14, through the drainage path of the connector tubes 24 and 24*a* and the main tube 28, and out the extension member 32. Movement of the extension member 32 to the "up" position, as shown in FIG. 5*a*, can cut off the water flow—for example, to hold water from being directed out the extension member 32, possibly to prevent drained water from dripping on a near-by person.

Figure 10A:
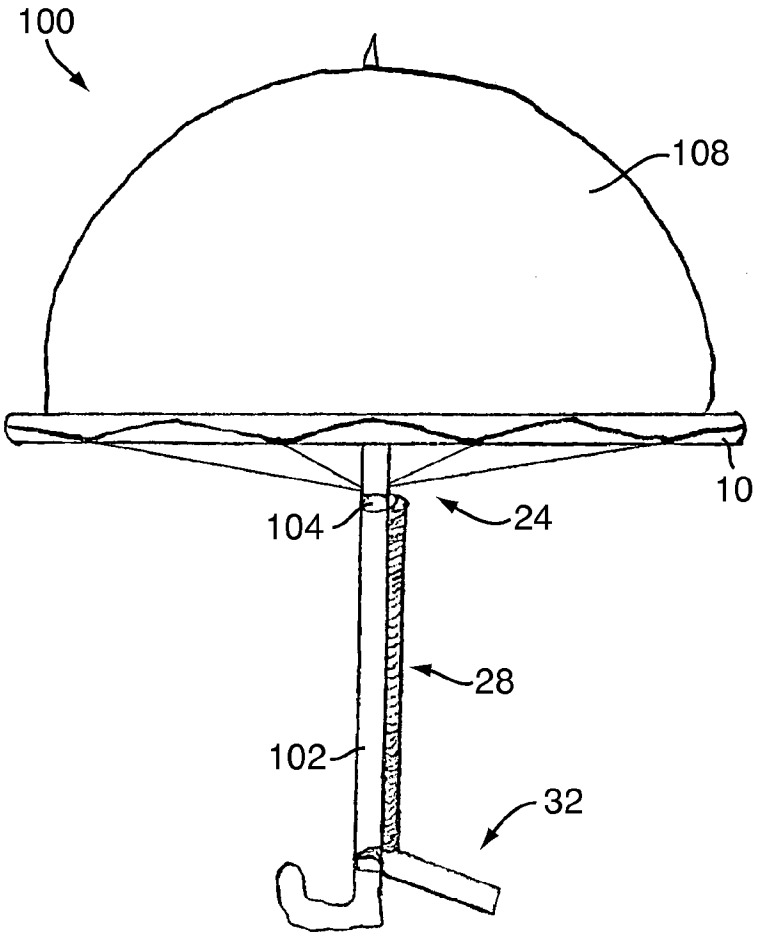
FIGS. 10 and 10*a* show side planar views of the umbrella of FIG. 1 fitted with an alternate embodiment of a detachable gutter system in accordance with the present invention.
Figure 10:
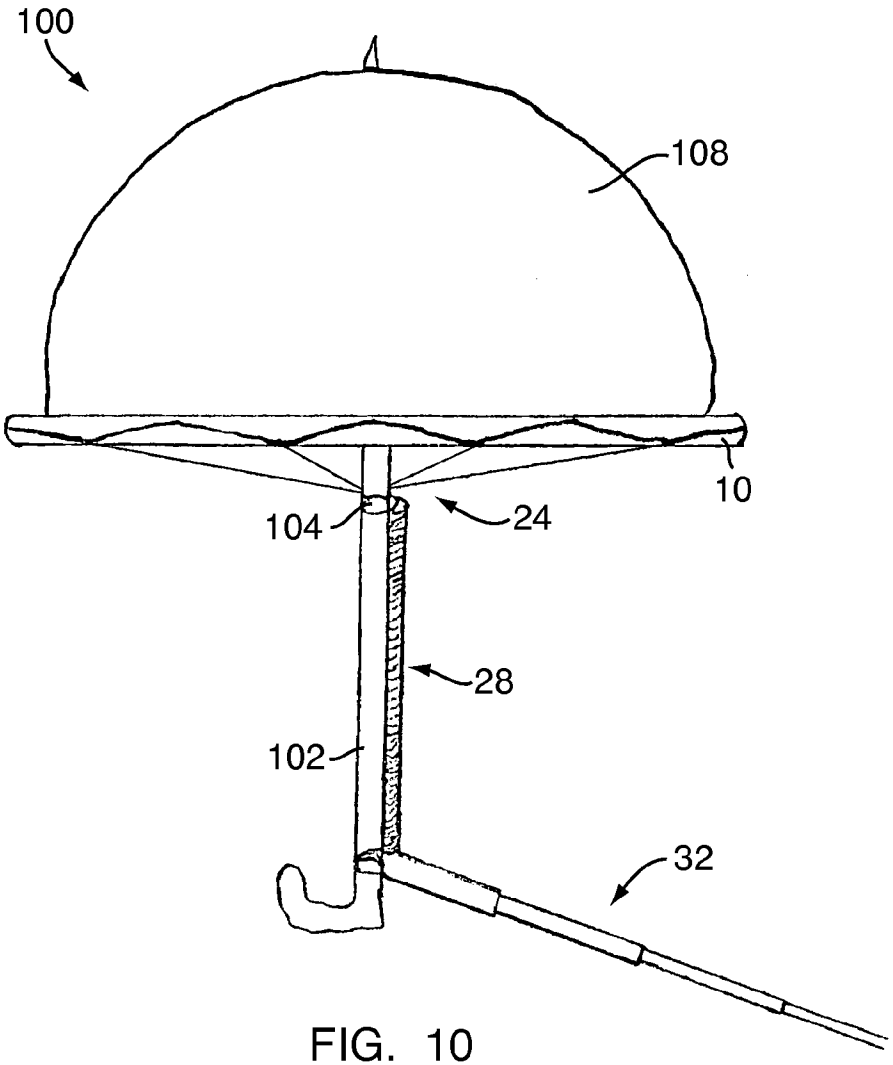

FIGS. 10 and 10*a* show another embodiment of the detachable gutter system of the present invention installed on a traditional umbrella 100. As shown, the main tube 28 is attached adjacent to the central pole 102 of the umbrella 100 and directs water through a drainage path to an extension member 32 that resembles a telescopically extendable antenna moveable between an extended condition and a retracted condition. When the extension member 32 is extended, as shown in FIG. 10, the drainage path is opened to allow water to flow therethrough. When retracted, as shown in FIG. 10*a*, flow through the extension member 32, and thus the drainage path, can be stopped. The extension member 32 may also be pointed in a direction selected by the user to release the water as desired. The extension member 32 is held in place by the clip 34, whether it is in its extended or retracted condition.

FIG. 7 shows a cross-sectional view of the clip 34 that holds the extension member 32 to the central pole 102 of the umbrella 100. As shown, a screw 36 is used to adjust the grip of the clip 34 on the central pole 102. An extension bracket 38 shows where the extension member 32 is positioned within the clip 34 and held using a screw 40 that is used to adjust the grip of the clip 34 on the extension member 32.

FIG. 8 shows a cross-sectional view of the clip 30 that holds the main tube 28 to the umbrella 100, for example, to the adjustor 104 of the umbrella 100 near the point where connector tubes 24 feed into the main tube 28. As shown, a screw 42 used to adjust the grip of the clip 30 on the adjustor 104, or alternatively on the central pole 102 of the umbrella 100. A main bracket 44 shows where the main tube 28 is positioned and retained within the clip 30 and held using a screw 46 that is used to adjust the grip on the main tube 28.

In alternative embodiments of the detachable gutter system, the drainage path may utilize a bellows-like design so that the umbrella 100 can be opened and closed with the detachable gutter system in place. Such an embodiment is partially illustrated in FIGS. 9 and 9*a*, which show the central point 26 at which multiple connector tubes 24 feed into a main tube 28' via a connection mechanism to direct the drained water to an extension member 32, such as illustrated in FIGS. 5 and 10. As shown, this connection mechanism comprises a bellows portion 48 designed to fold like the bellows of an accordion when the umbrella 100 is in its closed condition. In use, the bellows portion 48 acts as the main drainage tube between the connector tubes 24 and the stationary main tube portion 28'. In accordance with such operation of a bellows structure, the bellows portion 48 has an extended condition and a retracted condition with a first end that is connected to the adjustor 104 of the umbrella 100 for movement therewith and a second end fixed in place such that the umbrella 100 can be closed and opened with the detachable gutter system attached thereto. In FIG. 9, the bellows portion 48 is shown in its retracted condition, generally associated with the closed condition of the umbrella 100. In FIG. 9*a*, the bellows portion is shown in its extended condition, generally associated with the open condition of the umbrella 100, whereby water may drain through the extended bellows portion 48 alongside the central pole 102 of the umbrella 100 during use of the umbrella 100. When the umbrella 100 is opened, and the adjustor 104 slides up the central pole 102, the top end of the bellows portion 48 also moves up the central pole 102 to the position creating the set-up shown in FIGS. 5 and 10, where the connector tubes 24 feed into the main tube 28' via the bellows portion 48.

The invention claimed is:

1. A detachable gutter system for draining water collected on an umbrella when the umbrella is in an open condition, wherein said umbrella includes a central pole, an adjustor mounted for movement on the central pole, a plurality of spokes extending from the central pole and movable between an open position and a closed position in connection with movement of the adjustor and generally corresponding with the open and closed condition of the umbrella, and a flexible fabric cover attached to the spokes, said gutter system comprising:

a gutter attachable to the umbrella about the perimeter thereof when said umbrella is in its open condition, said gutter defining a plurality of drainage points spread around the perimeter of the gutter;

at least one frame connector that connects the gutter to the umbrella via one or more spokes to hold the gutter in place relative to the umbrella when the umbrella is in its open condition; and a drainage path comprising a main tube generally extending down the central pole of the umbrella, a connector tube associated with each drainage point of the gutter and connected between said drainage point and the main tube to drain water from the gutter through the drainage path, and at least one intermediate connector tube between the connector tubes and the main tube, wherein two or more connector tubes join to combine water drained from their respective drainage points into said at least one intermediate connector tube, said drainage path having an open condition and a closed condition such that water collected by the gutter on an opened umbrella is drained through the drainage path when in its open condition and water collected by the gutter is prevented from being drained out of the drainage path when the drainage path is in its closed condition.

2. The detachable gutter system as claimed in claim 1, wherein the main tube of the drainage path comprises a bellows portion having an extended condition and a retracted condition with a first end that is connected to the adjustor of the umbrella for movement therewith and a second end fixed in place such that the umbrella can be closed and opened with the detachable gutter system attached thereto.

3. The detachable gutter system as claimed in claim 1, further comprising an extension member connected to the main tube of the drainage path, said extension member being movable between an extended condition and a retracted condition, said extended condition corresponding to the open condition of the drainage path and said retracted condition corresponding to the closed condition of the drainage path.

4. The detachable gutter system as claimed in claim 3, wherein the extension member is positioned in an angular relationship to the main tube of the drainage path when the extension member is in its extended condition and said drainage path is in its open condition.

5. The detachable gutter system as claimed in claim 4, wherein the extension member is pivotally connected to the main tube of the drainage path whereby it may be pivotally extended to its extended condition where it is positioned in an angular relationship to the main tube, and correspondingly pivotally retracted to its retracted position where it closes off the drainage path to prevent water from draining out the extension member.

6. The detachable gutter system as claimed in claim 4, wherein the extension member is telescopically moveable between its extended condition and its retracted condition.

7. The detachable gutter system as claimed in claim 3, wherein said drainage path has an opened condition and a closed condition such that water collected by the gutter on an opened umbrella is drained through the drainage path when in its open condition and water collected by the gutter is prevented from being drained through the drainage path when the drainage path is in its closed condition, and wherein said extended condition of the extension member corresponds to the open condition of the drainage path and said retracted condition of the extension member corresponds to the closed condition of the drainage path.

8. The detachable gutter system as claimed in claim 7, wherein the extension member is telescopically moveable between its extended condition and its retracted condition.

9. The detachable gutter system as claimed in claim 1, wherein the gutter comprises a plurality of gutter segments, each gutter segment including a drainage point.

10. The detachable gutter system as claimed in claim 1, further comprising eight drainage points equally spaced about the perimeter of the gutter, wherein each drainage point is associated with a respective connector tube, said connector tubes being divided into four pairs of adjacent tubes that direct drained water to four respective intermediate connector tubes that in turn direct drained water to the main tube of the drainage path.

11. The detachable gutter system as claimed in claim 1, wherein the at least one frame connector comprises a retractable elbow clip connectable between the gutter and a spoke of the umbrella.

12. The detachable gutter system as claimed in claim 11, comprising a plurality of retractable elbow clips equally spaced about the perimeter of the gutter and alignable with a respective spoke of the umbrella to connect the gutter to the umbrella via said spokes.

13. A detachable gutter system for draining water collected on an umbrella when the umbrella is in an open condition, wherein said umbrella includes a central pole, an adjustor mounted for movement on the central pole, a plurality of spokes extending from the central pole and movable between an open position and a closed position in connection with movement of the adjustor and generally corresponding with the open and closed condition of the umbrella, and a flexible fabric cover attached to the spokes, said gutter system comprising:

a gutter attachable to the umbrella about the perimeter thereof when said umbrella is in its open condition, said gutter defining at least one drainage point;

at least one frame connector that connects the gutter to the umbrella to hold the gutter in place relative to the umbrella when the umbrella is in its open condition; and a drainage path comprising a main tube generally extending down the central pole of the umbrella and the at least one connector tube connected between at least one drainage point of the gutter and the main tube to drain water from the gutter through the drainage path, said main tube comprises a bellows portion with a first end connected to the adjustor of the umbrella for movement therewith and a second end fixed in place such that the umbrella can be closed and opened with the detachable gutter system attached thereto.

14. The detachable gutter system as claimed in claim 13, further comprising an extension member connected to the main tube of the drainage path, said extension member being movable between an extended condition and a retracted condition and enabling a user of the umbrella to direct the flow of water collected by the gutter and drained through the drainage path out of the extension member.

15. The detachable gutter system as claimed in claim 13, further comprising a plurality of drainage points spread around the perimeter of the gutter, wherein each drainage point is associated with a respective connector tube of the drainage path.

16. The detachable gutter system as claimed in claim 15, wherein two or more connector tubes join to combine water drained from their respective drainage points, wherein the drainage path further comprising intermediate connector tubes for draining water from two or more connector tubes to the main tube of the drainage path.

17. The detachable gutter system as claimed in claim 15, further comprising eight drainage points equally spaced about the perimeter of the gutter, wherein each drainage point is associated with a respective connector tube, said connector tubes being divided into four pairs of adjacent tubes that directed drained water to four respective intermediate connector tubes that in turn direct drained water to the main tube of the drainage path.

18. The detachable gutter system as claimed in claim 13, wherein the at least one frame connector comprises a retractable elbow clip connectable between the gutter and a spoke of the umbrella.

* * * * *